US006116206A

United States Patent [19]

Krentz

[11] Patent Number: 6,116,206

[45] Date of Patent: Sep. 12, 2000

[54] INTAKE MANIFOLD COVER

[75] Inventor: Kenneth R. Krentz, Lansing, Mich.

[73] Assignee: General Motors Corporation, Detroit, Mich.

[21] Appl. No.: 09/314,401

[22] Filed: May 19, 1999

[51] Int. Cl.[7] ..... F01N 35/104

[52] U.S. Cl. ..... 123/198 E

[58] Field of Search ..... 123/184.21, 184.61, 123/198 E; 181/204, 229, 224, 240

[56] References Cited

U.S. PATENT DOCUMENTS

| | | | |
|---|---|---|---|
| 3,596,695 | 8/1971 | Stevenazzi | 123/198 E |
| 4,137,888 | 2/1979 | Allan | 123/198 E |
| 4,257,368 | 3/1981 | Hofbauer | 123/198 E |
| 4,470,378 | 9/1984 | Malik et al. | 123/52 M |

FOREIGN PATENT DOCUMENTS 410274116 10/1998 Japan .

*Primary Examiner*—Willis R. Wolfe
*Assistant Examiner*—Hyder Ali
*Attorney, Agent, or Firm*—Laura C. Wideman

[57] ABSTRACT

An internal combustion engine includes engine cylinders in an engine block with intake ports to deliver charged air to the cylinders. An intake manifold conducts intake charge to the intake ports. A noise cover encapsulates the intake manifold. The noise cover comprises a noise abatement element substantially covering the intake manifold to abate noise transmitted by the intake manifold and a shell to encapsulate the noise abatement element. The shell is comprised of first and second portions, fastened to each other by integral-to-the-shell fasteners, to secure the noise cover about the intake manifold without mounting the noise cover to a potential noise source.

4 Claims, 4 Drawing Sheets

INTAKE MANIFOLD COVER

TECHNICAL FIELD

The invention is directed to a noise cover for an intake manifold of an internal combustion engine.

BACKGROUND OF THE INVENTION

Noise is generated by an internal combustion engine due to engine vibration, internal pressure pulsations, and combustion. The noise may radiate from the exterior surface of the engine intake manifold. An intake manifold cover may be used to attenuate such undesirable noise. The cover is typically bolted directly to the engine cylinder head or block, or other engine system component. The effectiveness of such covers is often not optimal due to noise transmission from the engine to the cover through the fastening means. Also due to packaging requirements, the cover may not substantially encapsulate the manifold allowing noise to escape.

SUMMARY OF THE INVENTION

The present invention provides for an internal combustion engine having an intake manifold encapsulated by a noise cover. The noise cover is comprised of a noise abatement element, which is a noise damping material substantially covering the intake manifold, and a rigid, protective outer shell. The shell may be made of two portions which are fastened to each other to secure the noise cover about the manifold. The fastening means may be achieved by injection molded fasteners integral to the shell. Since the cover is not fastened to the engine or other noise generating source, a potential noise transmission path is eliminated. The cover provides isolation of the intake manifold by decoupling the noise cover shell from the noise source.

The details, as well as other features and advantages of the invention, are set forth in the following detailed description and drawings.

DESCRIPTION OF THE PREFERRED EMBODIMENT

Figure 1:
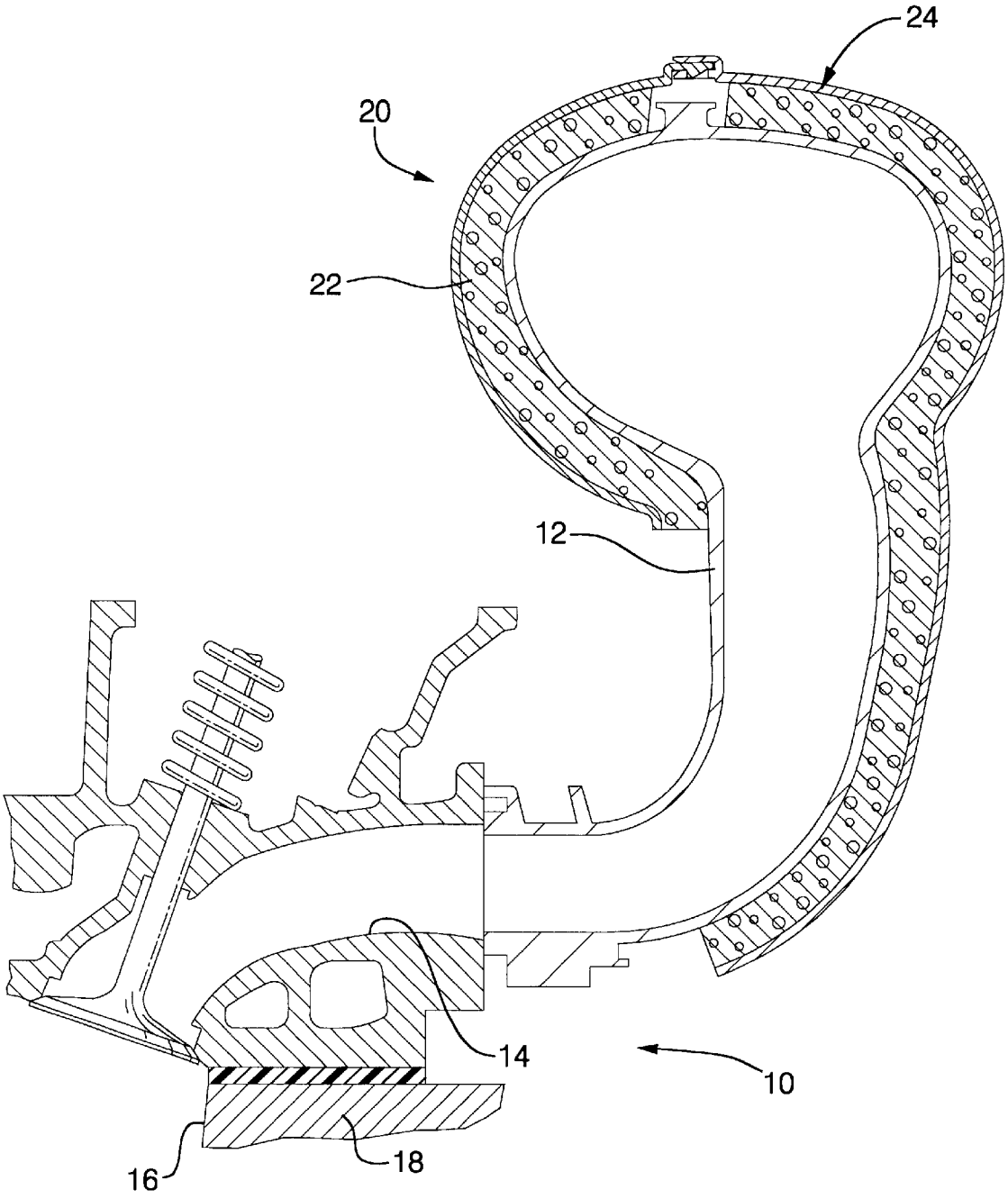
FIG. 1 is a front view section of a portion of an internal combustion engine with an intake manifold embodying the present invention.

FIG. 1 illustrates a portion of an internal combustion engine 10 such as a multi-cylinder, in-line engine that utilizes an intake manifold 12 to conduct intake charge to intake ports 14 of the engine. The intake ports 14 deliver intake charge to the engine cylinders 16 of the engine block 18. Noise generated during combustion, and due to engine vibration and internal pressure pulsations, may be radiated through the intake manifold 12. Therefore, an intake manifold noise cover 20 encapsulates the intake manifold 12 by covering a substantial amount of the manifold exterior surface area to abate noise transmission through the manifold and noise generated off the external surface of the manifold.

Figure 3:
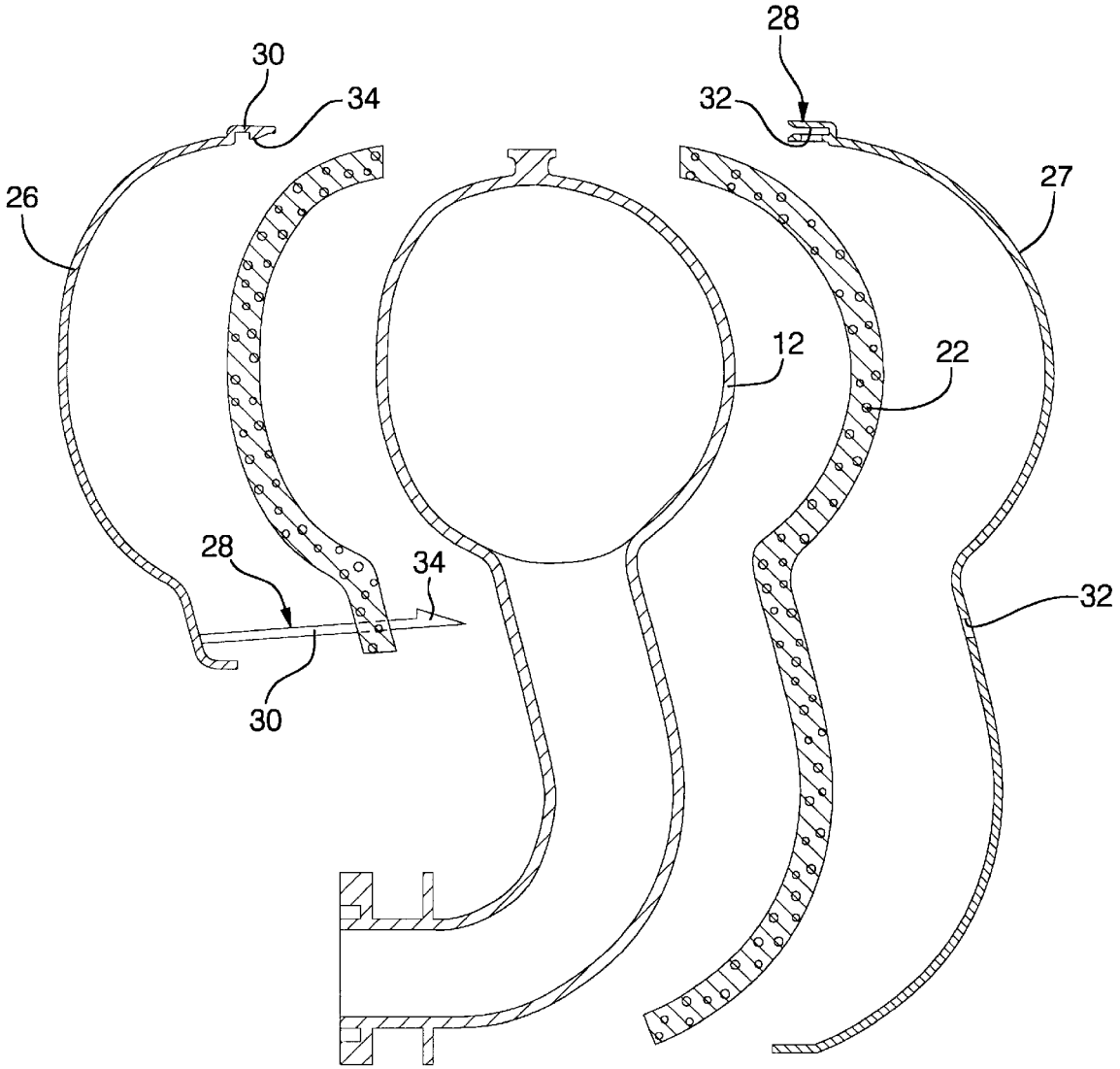
FIG. 3 is an elevational, front view section of the present invention.
Figure 4:
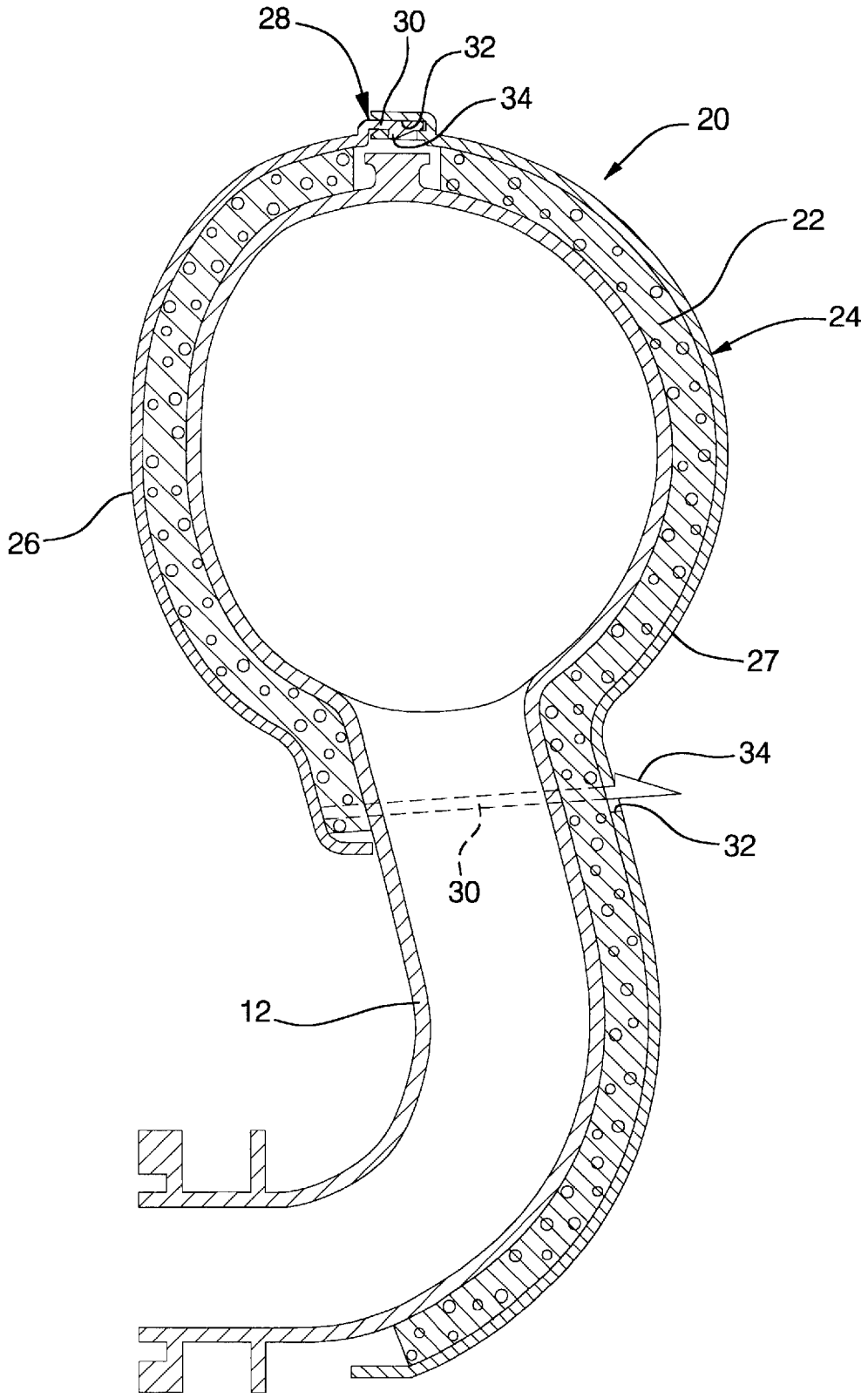
FIG. 4 is a front view section of the present invention.

As shown in FIGS. 3 and 4, the noise cover 20 is comprised of a noise abatement element 22, referred to as the liner, and a shell 24 that covers and protects the outside of the liner and serves as the structural component of the cover. The liner 22, made of a noise damping material, may be shaped to complement and substantially cover the exterior surface of the intake manifold 12. Exception may be made due to the geometry of the manifold and for such features as bolt bosses. The shell 24 may be comprised of a first and a second portion 26 and 27 respectively, which when assembled enclose the liner 22. The shell 24 is made of a rigid plastic material that may be injection molded. When the shell 24 and liner 22 are assembled, the liner is tightly interposed between the shell and the intake manifold 12, as shown in FIG. 4. Slightly compressing the liner 22 against the exterior surface of the manifold 12 aids in damping manifold vibrations.

Figure 2:
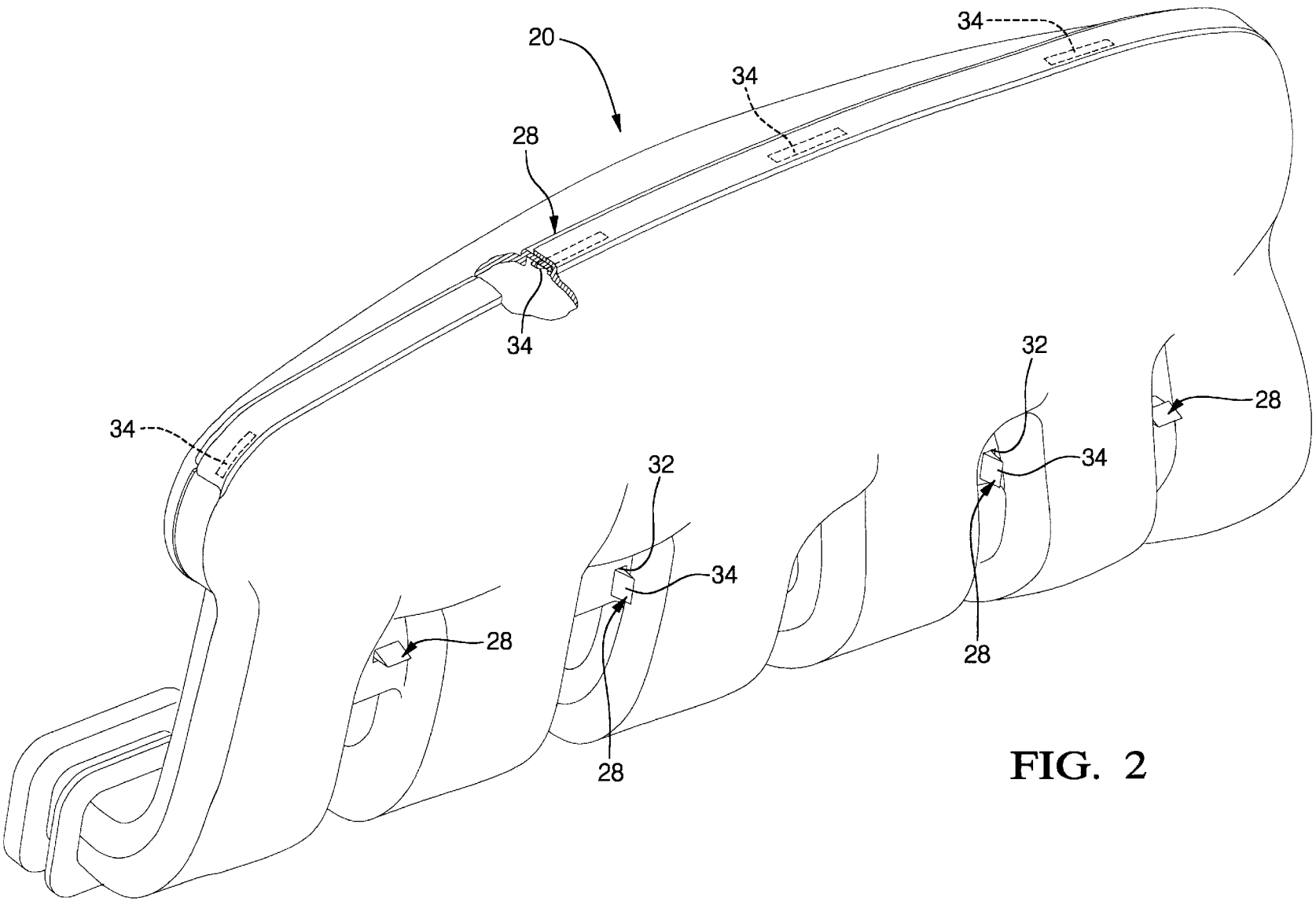
FIG. 2 is an isometric view of the present invention.

The noise cover 20 is self-fastening in that the first and second portions 26,27 of the shell 24 are fastened to each other, either by separate fasteners or preferably with integral-to-the-shell fasteners 28 that have the advantage of not requiring separate fastening components and may be injection molded as a part of the shell 24. See FIGS. 2–4. Snap fit interference fasteners may be used as integral fasteners 28. As shown in FIGS. 3 and 4, a snap fit fastener 28 may include a tab 30 with a barb 34 on an insertion end that is inserted in a mating slot 32, where the barb snaps into engagement once the tab is fully received in the mating slot. Such integral-to-the-shell fasteners 28 provide alignment and securement of the first and second portions 26,27 of the shell 24. Since there are no fasteners between the noise cover and the engine, a noise path is not created therebetween.

The self-fastening cover 20 may reduce assembly costs in that separate fasteners are not required to attach the noise cover about the intake manifold. In addition, the manifold supplier may deliver the intake manifold with the noise cover already assembled about the manifold, instead of attaching the cover during engine assembly thereby saving time and cost. Because of this single package assembly, the noise cover does not interfere with other engine components and need not be removed to service other engine components.

It should be noted that such a self-fastening noise cover may be used to encapsulate other noise sources within an internal combustion engine besides an intake manifold, while still utilizing the principles of this invention.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An internal combustion engine, comprising an intake manifold to conduct intake charge to intake ports and a noise cover encapsulating said intake manifold including a noise abatement element substantially covering said intake manifold to abate noise transmitted by said intake manifold and a shell to encapsulate said noise abatement element wherein said noise abatement element is tightly interposed between said shell and said intake manifold, compressing said noise abatement element.

2. An internal combustion engine, as defined in claim 1, wherein said shell is comprised of a first and a second portion fastened to each other by integral fasteners to secure said noise cover about said intake manifold.

3. An internal combustion engine, as defined in claim 2, wherein said shell is injection moldable material.

4. An intake manifold for an internal combustion engine, comprising a noise cover encapsulating said intake manifold including a noise abatement element substantially covering said intake manifold to abate noise transmitted by said intake manifold and a shell to encapsulate said noise abatement element wherein said shell is comprised of a first and a second portion fastened to each other by integral fasteners to secure said noise cover about said intake manifold.

* * * * *